US005136938A

United States Patent [19]

Pellegrina

[11] Patent Number: 5,136,938

[45] Date of Patent: Aug. 11, 1992

[54] MULTICOLOR SILK SCREEN PRINTING APPARATUS WITH HEATING AND COOLING STATIONS ARRANGED AROUND A TURRET

[75] Inventor: Ercole Pellegrina, Rozzano, Italy

[73] Assignee: C.M.S. S.r.l., Milan, Italy

[21] Appl. No.: 560,635

[22] Filed: Jul. 31, 1990

[30] Foreign Application Priority Data

Apr. 24, 1990 [IT] Italy ..... 20133 A/90

[51] Int. Cl.[5] ..... B41F 15/10; B41F 15/12

[52] U.S. Cl. ..... 101/115; 101/424.1; 101/488

[58] Field of Search ..... 101/115, 424.1, 126, 101/129, 488

[56] References Cited

U.S. PATENT DOCUMENTS

| | | | |
|---|---|---|---|
| 2,484,671 | 10/1949 | Bauman | 101/115 |
| 2,907,118 | 10/1959 | Maescher | 34/155 |
| 3,221,646 | 12/1965 | Hardy, Jr. et al. | 101/115 |
| 3,751,204 | 8/1973 | Baker | 101/123 X |
| 4,233,901 | 11/1980 | Mallinson | 101/424.1 |
| 4,434,562 | 3/1984 | Bubley et al. | 101/424.1 X |
| 4,504,220 | 3/1985 | Sunakawa et al. | 101/424.1 X |
| 4,590,854 | 5/1986 | Anderson | 101/115 X |
| 4,671,174 | 6/1987 | Tartaglia et al. | 101/115 |

FOREIGN PATENT DOCUMENTS

| | | | |
|---|---|---|---|
| 8701392 | 9/1989 | Belgium . | |
| 20203792 | 12/1986 | European Pat. Off. . | |
| 0340822 | 11/1989 | European Pat. Off. | 101/115 |
| 1488233 | 7/1967 | France . | |
| 619844 | 3/1949 | United Kingdom . | |

*Primary Examiner*—Clifford D. Crowder
*Attorney, Agent, or Firm*—Browdy and Neimark

[57] ABSTRACT

A silk screen printing process onto a support with a reduced ink absorption including, after each silk screen printing phase onto a support to be submitted to silk screen printing, at least a first heating phase of the support and at least a second forced cooling phase of said support, the second phase being immediately successive to the first phase. The process is carried out by a plant (1) including, after each printing station (2), a heating station (5) acting onto the silk-screened support (14) and a cooling station (6) active onto the same support (14) to be submitted to silk screen printing.

1 Claim, 3 Drawing Sheets

MULTICOLOR SILK SCREEN PRINTING APPARATUS WITH HEATING AND COOLING STATIONS ARRANGED AROUND A TURRET

BACKGROUND OF THE INVENTION

The present invention has for its subject-matter a silk screen printing process and plant onto a support with a reduced ink absorption.

As it is known, the silk screen process usually employs more following prints onto a same article or support, e.g. for the application of various colours. Therefore there are foreseen various printing stations, in succession with one another and made with great precision, and the support to be printed is submitted in each station to a well-established printing phase.

If this support can easily absorb the ink, it occurs a quick stabilization of the same ink after each print station. Therefore each colour can be applied onto the support without making unwanted mixings or reactions or interferences with the previously applied colours. On the contrary if the support to be submitted to silk screen printing is made up of a material having a limited or null absorption capacities, such as e.g., PVC, glass, plexiglas, leather, and plastic material of various types, it is generally possible to make a sole operation of silk screen printing.

In fact the applied ink remains in surface and dries very slowly, making it in practice, impossible to make a complete cycle of silk screen printing with many colours, it being impossible to print onto a support that is not completely dried. Accordingly, to be successful requires a succession of the printing phases very slowed down and prolonged in time.

SUMMARY OF THE INVENTION

In this situation the technical aim of the present invention is to supply a process and a plant suitable for obviating substantially the above mentioned drawbacks.

The technical aim is substantially achieved by a silk screen printing process of the type having a plurality of silk screen printing phases made in succession with one another onto a support showing a face to be printed by silk screen printing, including, between two following silk screen printings: a first heating phase of said face of said support, and a second forced cooling phase of said face, made after said first phase.

The process is achieved by a silk screen printing plant of the type including a plurality of printing stations in succession with one another, and transport means suitable for moving among said printing stations a support having a face to be submitted to silk screen process, comprising, between each printing station couple following after one another, at least two supplementary stations including: a heating station acting onto said face of said support and a cooling station, also this station being active onto said face of said support.

BRIEF DESCRIPTION OF THE DRAWINGS

Further features and advantages of the invention shall appear from the description of a preferred fulfilment form of the process and plant according to the invention, making reference to the annexed drawings, in which.

DETAILED DESCRIPTION OF THE INVENTION

The silk screen printing process according to the invention occurs as follows.

After a silk screen printing phase made up onto an print article or support with reduced ink absorption, it is necessary to be sure, before making another silk screen printing phase onto the same support, that the deposited ink is completely insensible to the following printing phase.

For example, if during the first phase it is applied a certain colour and another colour is applied in the following printing phase, it is necessary to be sure that the second colour does not react with the first colour. This situation is reproduced many times during the four-colour process printings.

Therefore it is made, according to the invention, a first heating phase of the silk screen-printed face of the printing support. The heating phase causes a quick vaporisation of the just deposited ink.

Yet some experimental tests made by the same Applicant have shown that the heating does not causes satisfactory or complete results, if it must be followed by a new printing phase.

In fact the just deposited ink tends to dry under the action of the heat, but remains fixed in a bad manner, uncompact and its surface is not hardened, causing a sensibility to the following printing operations.

The experimental tests made by the Applicant have also shown that for remedying to this situation it is substantially useless to increase the heating, unless the same heating is prolonged for very long time periods, this operation being naturally incompatible with the normal sequence of the printing operations.

On the contrary, for stabilizing the ink completely and within short times on any support, it is necessary, according to the invention, to act in a direction opposite to the heating: it is necesssary to interrupt the heating and make immediately a forced cooling phase. In this manner the ink hardens and losses its fluidity in particular in its surface until the moment in which it is insensible to the following printing operations.

The two phases are both necessary also for allowing the use of supports easily expandible under the action of the heat, such as e.g. some known plastic materials.

In fact the heating expands slightly these supports and this limited expansion can be sufficent for making imprecise the following printing operations. The immediate and forced cooling restores the initial printing conditions.

The heating and cooling phases are made by means of air circulation and advantageously the cooling air is kept at ambient temperature, so that the conditions existing at the moment of the first printing are exactly restored.

Figure 1:
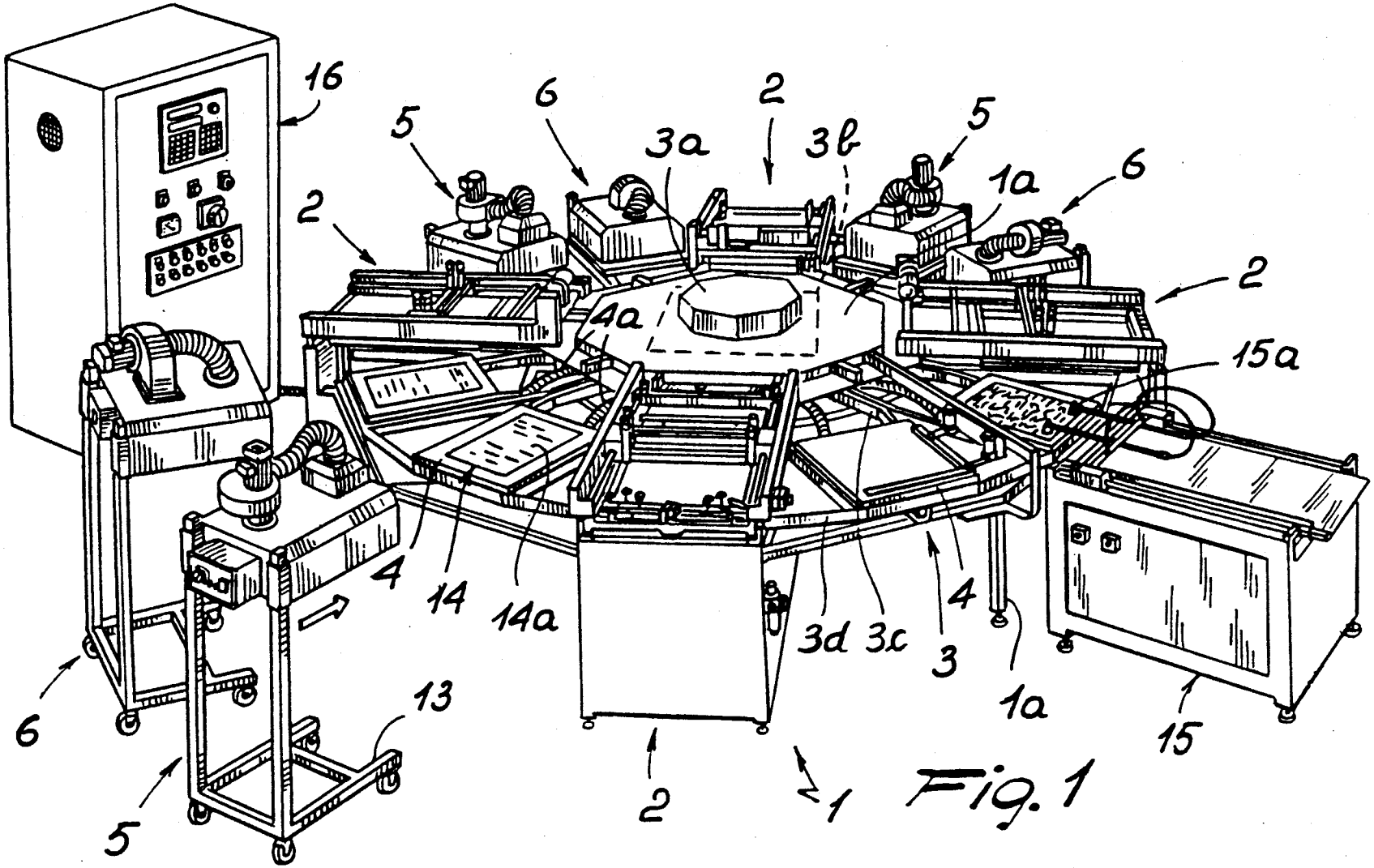
FIG. 1 shows in perspective View a plant according to the invention.
Figure 2:
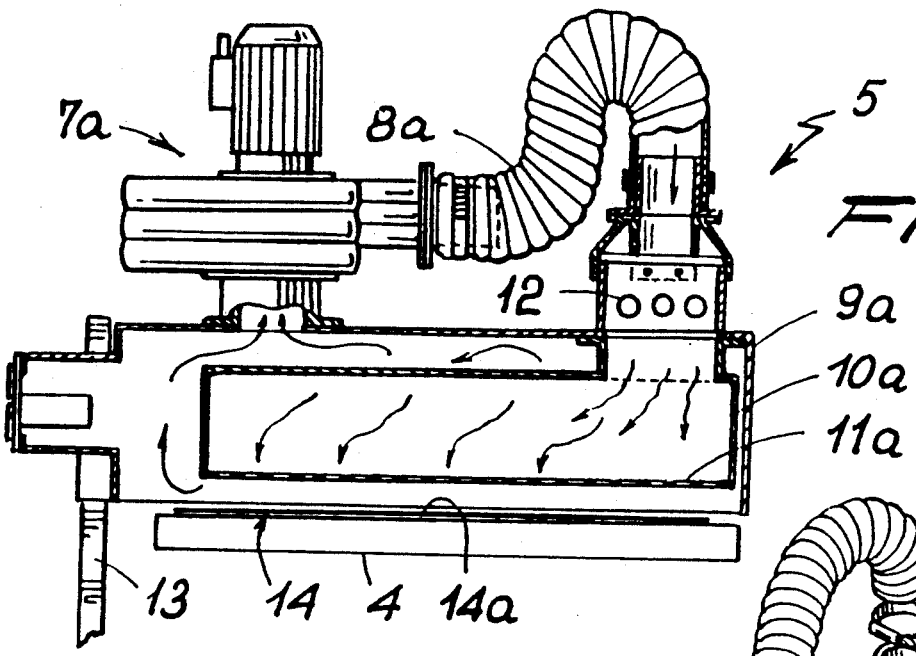
FIG. 2 is a longitudinal section of a component of FIG. 1.
Figure 3:
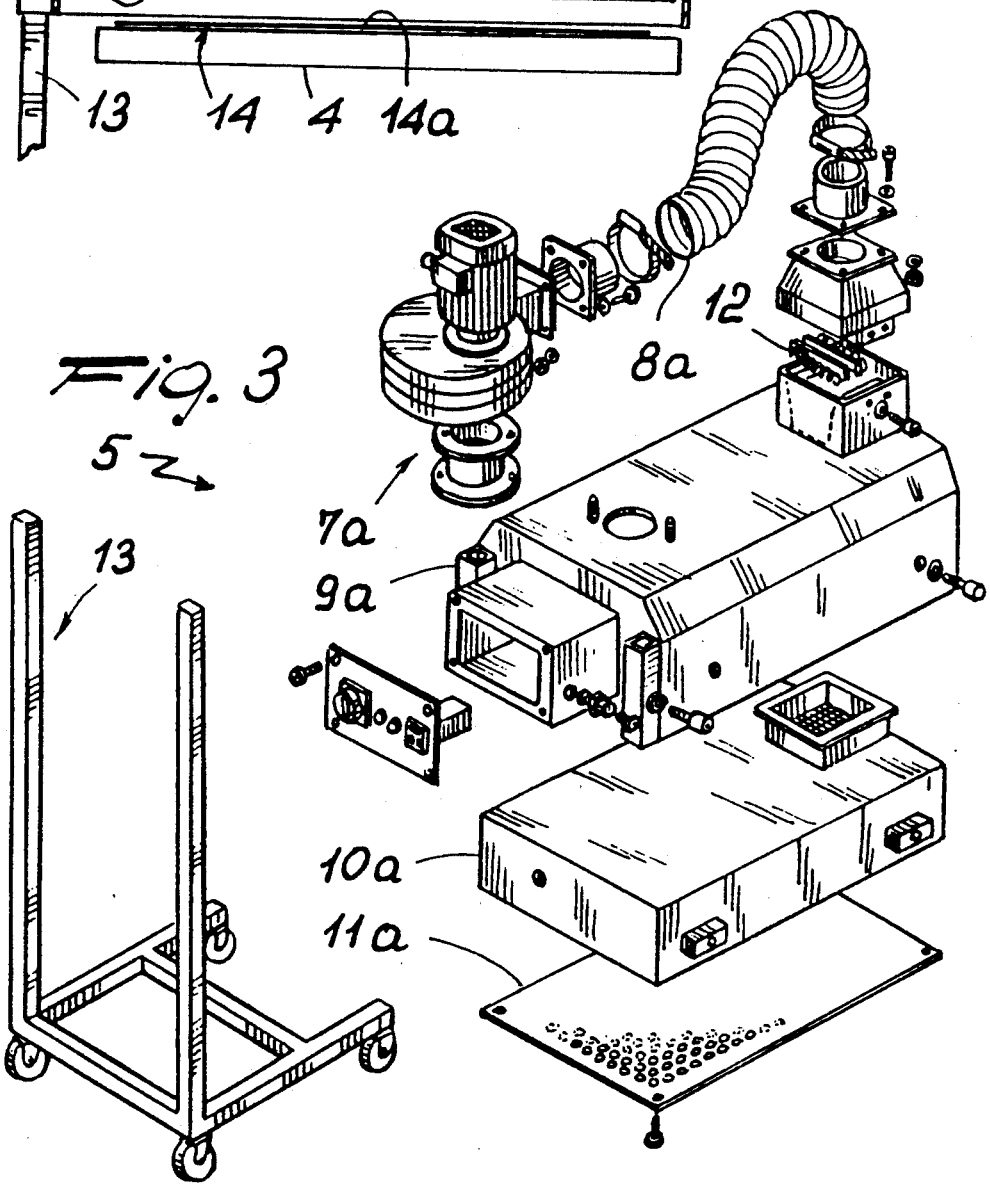
FIG. 3 shows in perspective and exploded view the component of the plant of FIG. 2.
Figure 4:
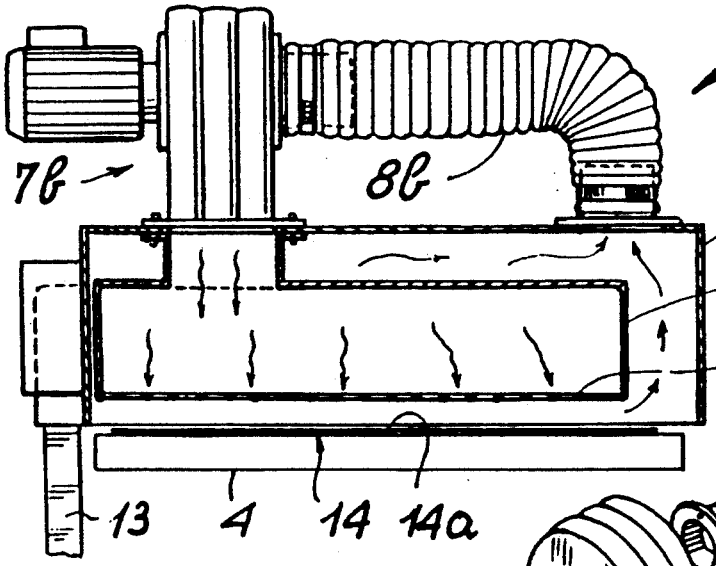
FIG. 4 is a section of another component of FIG. 1.
Figure 5:
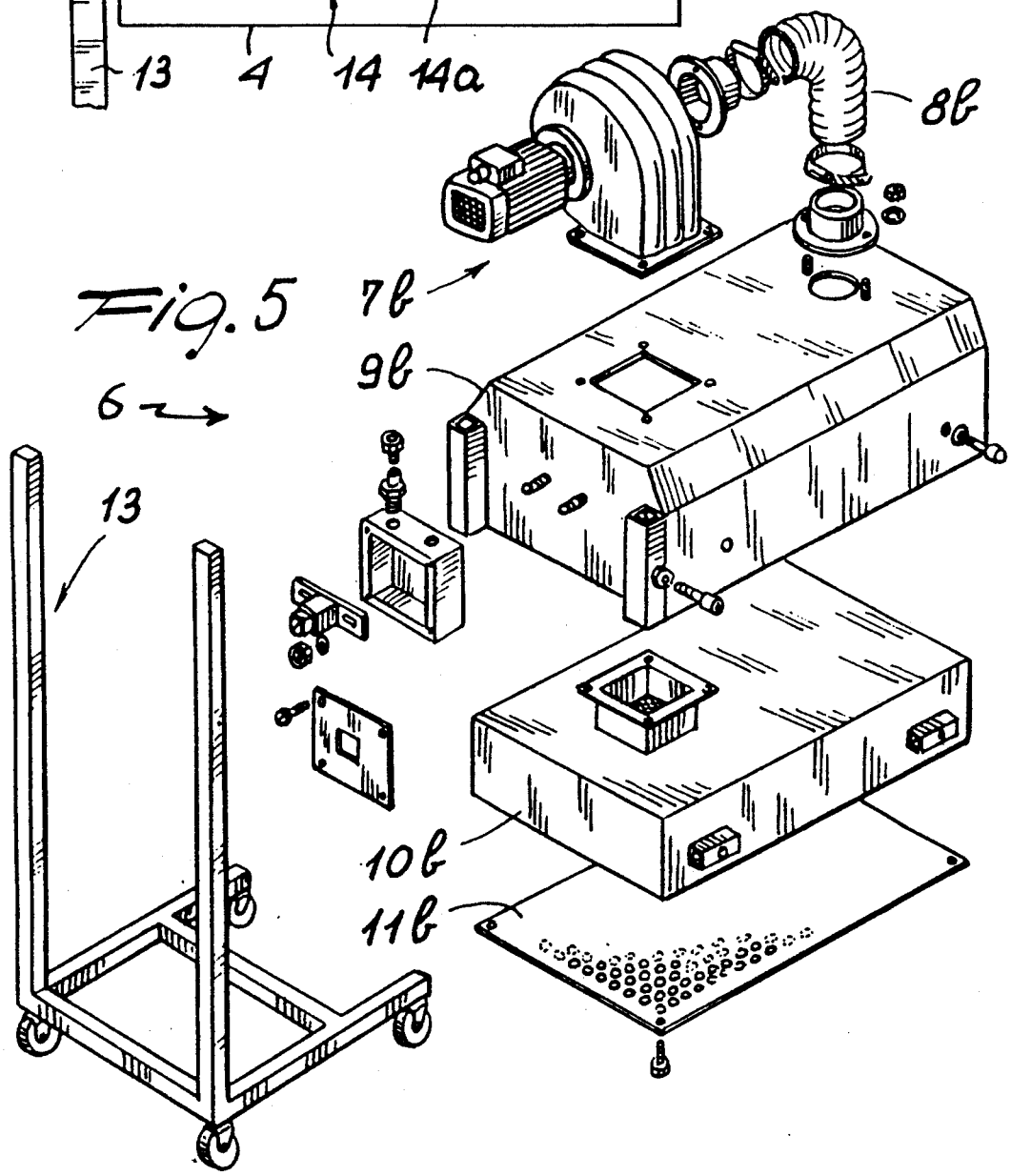
FIG. 5 shows in perspective and exploded view the component of the plant of FIG. 4.

The process according to the invention is carried out by a plant indicated by the number 1 in FIG. 1.

It includes a fixed frame 1*a* to which printing stations 2 are joined. In each printing station 2 a silk screen printing is carried out onto a face 14*a* of an article or support 14 with a reduced ink absorption. The shown specific example indicates a fixed frame 1*a* with circular development and printing stations 2 that are four in number, for making the four-colour printing or four-colour process.

On the fixed frame 1*a* and in the space among the printing stations 2, transport means 3 is provided holding the supports 14 to be submitted to silk screen printing.

The transport means 3 includes a central pin 3*a* and drive members 3*b* located in conjuction with the central pin 3*a*. Further it includes a lattice rotating around the central pin 3*a* under the control of drive members 3*b* and shaped in a closed ring form.

The rotating lattice has, as shown in FIG. 1, arms 3*c* that are developed in substantially radial direction with respect to the pin 3*a* and an external annular element 3*d*.

The arms 3*c* and the external annular element 3*d* are fixed to tables 4 suitable for holding the articles or supports 14 to be submitted to silk screen printing.

These tables 4 including arms 3*c* and element 3*d* are laid directly, in a sliding manner, onto the fixed frame 1*a*.

The tables 4 are also joined with suction members 4*a* leading by many little holes onto the top surfaces of the same tables 4, with the aim of holding by suction and with precision the supports 14 to be submitted to silk screen process.

The transport means 3 establishes an intermittent progress of the tables 4 along their trajectory in closed ring form and make not only main stop positions in conjuction with the printing stations 2, but also, advantageously, two intermediate stop positions between each following main stop position couple.

In particular the transport means 3 includes, in conjuction with the drive members 3*b*, positioning and stop members, e.g. block cylinders and related stops, calibrated in a manner suitable for locking precisely said rotating lattice in conjuction with progress pitches or sections of the tables 4, having a length equal to a third of the distance between two following printing stations 2.

The tables 4 are in number and position suitable for engaging contemporaneously all of said stop positions. Therefore when the transport means 3 is in stop conditions, the support tables 4 are located in all printing stations 2 and in two intermediate positions between two following printing stations 2.

Originally two supplementary stations, formed by a heating stations 5 and a cooling station 6, both being active onto a face of the support 14 to be submitted to silk screen printing are provided between each following printing station couple 2, in conjuction with the above mentioned two intermediate positions.

The heating stations 5 and cooling station 6 include ventilation devices, respectively 7*a* and 7*b*, suitable for fulfilling air flows, to be sent onto the support 14 and at least partially recycled by means of flow pipes, respectively 8*a* and 8*b*, and holding walls, respectively 9*a* and 9*b*.

Further the heating and cooling stations 5 and 6 have expansion chambers, respectively 10*a* and 10*b*, fed by ventilation devices 7*a* and 7*b* diffuser elements, respectively 11*a* and 11*b*, adjacent to the face 14*a* of the article or support 14.

The heating station 5 includes electric resistances 12 suitable for heating the air flow coming from the ventilation device 7*a* and can be positioned, by means of a trolley 13, in operative position or in wait position. Also the cooling station 6 includes a trolley 13 that allows its movements.

At the end of the ring trajectory caused by the transport means 3, there is an extraction station !5 supplied with extraction suckers 15*a*. Between the extraction station 15 and the last printing station 2, the supplementary stations 5, 6 are generally useless, as the Just deposited ink is not submitted to a following silk screen printing phase.

Between the extraction station 15 and the first printing station 2 there is provided the loading zone of supports 14 onto the tables 4 and therefore in this zone there is at least a table 4, or also many tables, free from any work station.

A control panel 16 for adjusting the running parameters of the plant 1 is placed on a side of the fixed frame 1*a*.

The running of the plant occurs as follows.

An article or support 14 to be submitted to silk screen printing is loaded onto a table 4 and then it is immediately submitted to a silk screen printing with a first colour onto the face 14*a* thereof in a first printing station 2. Then the support 14 is transfered to the adjacent heating station 5 by means of the table 4 on which it is fixed.

The hot air sent from the ventilation device 7*a*, expanding into the expansion chamber 10*a*, is distributed onto the support 14 through the grate diffusion element 11*a* and is recycled in a great part, being held over the same support 14 by means of the closing wall 9*a*.

In the following the transport means 3 transfers the support 14 in conjuction with the adjacent cooling station 6, where the air at ambient temperature collides with the printed face of the same support and is recycled onto itself by means of the closing wall 9*b* of the flow pipe 8*b*.

Then the support 14 is transferred to another printing station 2, where the transfer of a second colour is made.

Then other heating and cooling stations act onto the support 14 and in all of the colours the process is applied in a similar manner.

The invention achieves important advantages.

In fact it is possibile to make silk screen printing in many colours even onto supports that do not absorb ink. This result is achieved without reducing the operative rates, and on the contrary the operative rates are high as, before making any silk screen printing operation, the optimal printing conditions are restored in a quicker manner.

Further it is possible to make a silk screen printing with maximum precision with many colours even onto materials having thermal expansions relatively high.

I claim:

1. A silk screen printing plant for consecutively and separately printing different color ink patterns onto a support which does not absorb ink comprising:

at least four ink printing stations arranged around a rotary turret, said stations (2) having different ink patterns consecutive to one another;

transport means (3) engaged to said rotary turret for moving under said printing stations (2);

a support (14) which does not absorb ink having a face (14*a*) for silk screen printing said different colored ink patterns by said printing stations (2);

at least three pairs of two supplementary stations (5, 6) arranged around said rotary turret, each of said at least three pairs located between a couple of said printing stations (2), said supplementary stations consecutive with one another, and including a forced air heating station (5) acting on said face (14*a*) of said support (14) and a forced air cooling station (6) arranged after said forced air heating station and also acting on said face (14*a*) of said support (14), said forced air heating station (5) and said forced air cooling station (6) including ventilation devices (7*a*, 7*b*);

said transport means (3) engaged to said rotary turret including a plurality of tables (4), each thereof being suitable for bearing one said support (14), suction members (4*a*) being joined with said tables (4);

said transport means (3) being provided both with main stop positions in conjunction with said printing stations (2) and two intermediate stop positions between each couple of said following printing stations (2), said supplementary stations (5, 6) being placed in said intermediate stop positions;

and said transport means (3) being suitable for causing intermediate progresses of said tables (4) by pitches having a length equal to a third of the distance between two said consecutive printing stations (2).

* * * * *